US007661780B2

(12) United States Patent
Zhao et al.

(10) Patent No.: US 7,661,780 B2
(45) Date of Patent: Feb. 16, 2010

(54) TUNING APPARATUS FOR A PRINTHEAD

(75) Inventors: Yong Zhao, Jinmen (CN); Hai-Bo Shang, Xiangfan (CN)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 155 days.

(21) Appl. No.: 12/037,086

(22) Filed: Feb. 26, 2008

(65) Prior Publication Data

US 2009/0147048 A1 Jun. 11, 2009

(30) Foreign Application Priority Data

Dec. 10, 2007 (CN) ..... 2007 1 0197189

(51) Int. Cl.
*B41J 25/308* (2006.01)

(52) U.S. Cl. ..... 347/8; 347/20; 347/32

(58) Field of Classification Search ..... 347/8, 347/20, 32, 40, 41; 400/56, 59
See application file for complete search history.

(56) References Cited

U.S. PATENT DOCUMENTS 5,598,192 A * 1/1997 Burger et al. ..... 347/43
5,870,117 A * 2/1999 Moore ..... 347/37
7,270,387 B2 * 9/2007 Ueda et al. ..... 347/8

* cited by examiner

*Primary Examiner*—Thinh H Nguyen
(74) *Attorney, Agent, or Firm*—Kile Goekjian Reed & McManus PLLC

(57) ABSTRACT

A tuning element having a second inclined plane interacts with a pushing element having a first inclined plane to accomplish adjusting the position of a printhead. The tuning element rotates relative to a printhead carrier and produces displacement in a second direction and the second inclined plane of the tuning element then pushes the first inclined plane of the pushing element and produces displacement in a first direction in a linear way corresponding to the rotation of the tuning element. Meanwhile, the printhead closely in contact with the pushing element also produces displacement in the first direction so that the tuning apparatus is endowed with highly accurate and linear adjustability.

9 Claims, 10 Drawing Sheets

TUNING APPARATUS FOR A PRINTHEAD

BACKGROUND OF THE INVENTION

1. Field of the Invention

The present invention relates to a tuning apparatus, and more specifically, to a tuning apparatus for a printhead capable of linearly adjusting the displacement of the printhead via an inclined plane.

2. Description of the Prior Art

Printers at the present time are equipped with growing specific functions, design diversity, delicate process of manufacturing, and technology applied. With critical requirement for output quality, printers are made and assembled with exquisite components in which include the most substantial quality-related component, the printhead. Unfortunately, the printhead must face a challenge about its position displacement when assembled into the printer. The position displacement of a printhead is usually caused by manufacturing error of the printhead, assembly error of the components or component wearing during a period of time of operation. Many printers according to the prior art has tuning apparatus for its printer accordingly and the correction of the position displacement of the printhead is carried out before the first use of the printer or during the operation of the printer once the problem exists.

Please refer to FIG. 1. FIG. 1 is an illustration of a tuning apparatus 1 for a printhead according to the prior art. The tuning apparatus 1 comprises a carrier 10, an exertion component 20, and an eccentric cylinder 30. The exertion component 20 is fixed on the carrier 10 where a printhead (not shown in the figure) is located. The eccentric cylinder 30 has its eccentric hole rotatably configured on the carrier 10 and the eccentric cylinder 30 itself extending to a rectangular hole 21 of the exertion component 20, tangent to the left and right sides of the rectangular hole 21 and forming gaps between the top and bottom sides of the rectangular hole 21. The eccentric cylinder 30 pushes the exertion component 20 when rotating and therefore causes the carrier 10 to slightly move along the direction N1 or direction N2 for tuning the location of the printhead.

Please refer to FIG. 2 and FIG. 3. FIG. 2 is an illustration of every primary parameter of the eccentric cylinder 30 and FIG. 3 is an illustration of the relation between the rotation degree $\alpha$ of the eccentric cylinder 30 and the displacement t of the printhead, where R is the radius of the eccentric cylinder's outer circle, d is the eccentric distance of the eccentric cylinder's inner circle, and $\alpha$ is the rotation degree of the eccentric cylinder 30. The displacement t of the printhead caused by the rotation degree $\alpha$ of the eccentric cylinder 30 can be expressed by the following equation:

$$t=|\sqrt{R^2+d^2-2Rd\cos\alpha}-(R-d)|;$$

The above equation tells that the tuning apparatus 1 in the prior art possesses a nonlinear relation between the displacement t of the printhead and the rotation degree $\alpha$ of the eccentric cylinder 30, which is also shown in FIG. 3. As a result, the correction amount for the displacement of the printhead cannot be precisely tuned by rotating the eccentric cylinder 30. While in other practice of the prior art, the rotation degree of the eccentric cylinder 30 is calculated and inscribed thereon for adjusting the displacement of the printhead, and the nonlinear characteristic of the structure still leads to unsatisfactory accuracy.

SUMMARY OF THE INVENTION

The present invention provides a tuning apparatus for a printhead. The tuning apparatus comprises a carrier, a printhead device, a pushing element, and a tuning element. The printhead device is configured on the carrier and capable of having displacement relative to the carrier along a first direction. The pushing element is utilized for pushing the printhead device to move relative to the carrier along the first direction and has a first inclined plane. The tuning element is configured on the carrier and capable of having displacement relative to the carrier along a second direction. The tuning element has a second inclined plane for interacting with the first inclined plane of the pushing element, causing the pushing element to push the printhead device to move relative to the carrier along the first direction when the tuning element has displacement along the second direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
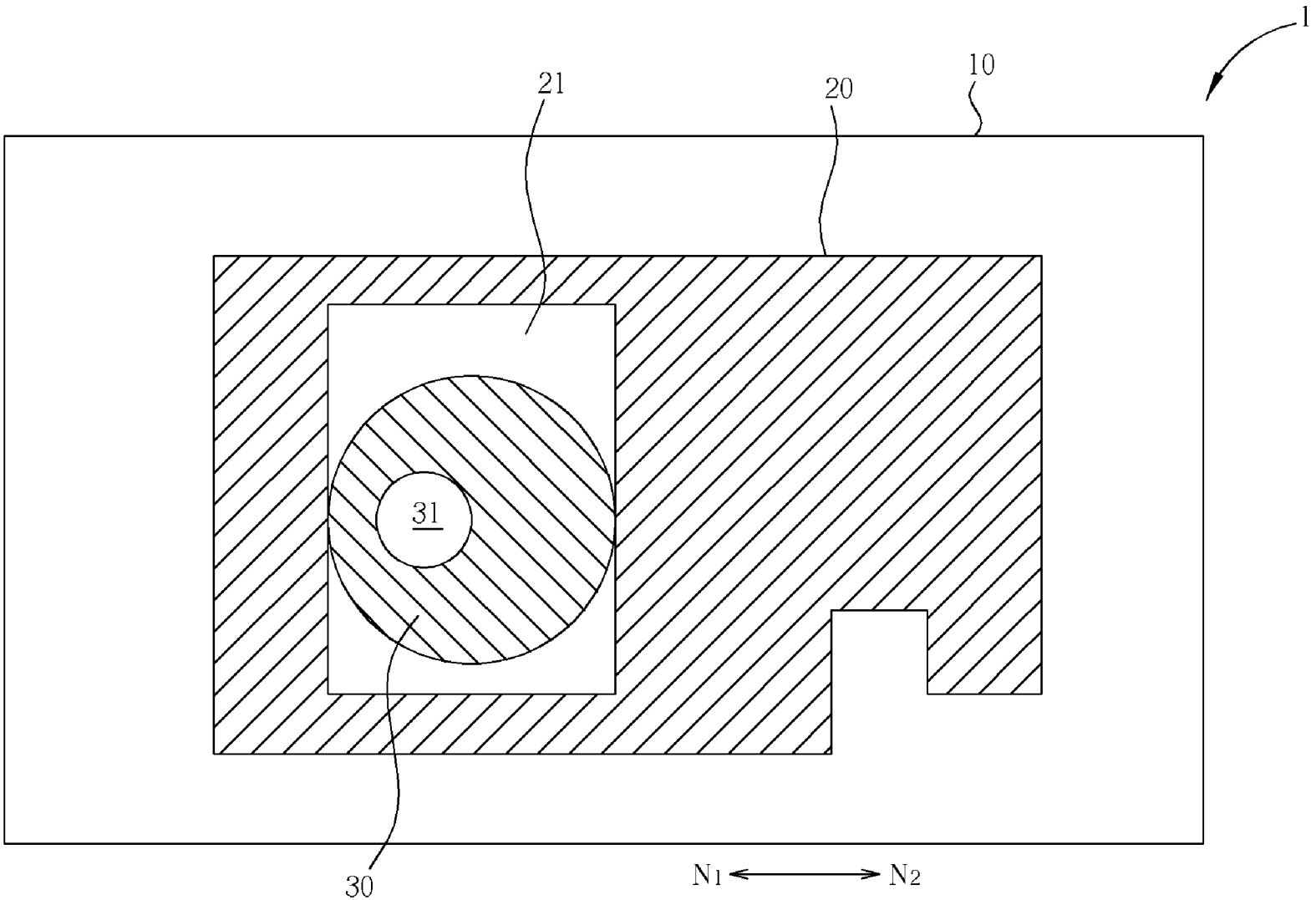
FIG. 1 PRIOR ART
FIG. 1 is an illustration of a tuning apparatus 1 for a printhead according to the prior art.
Figure 2:
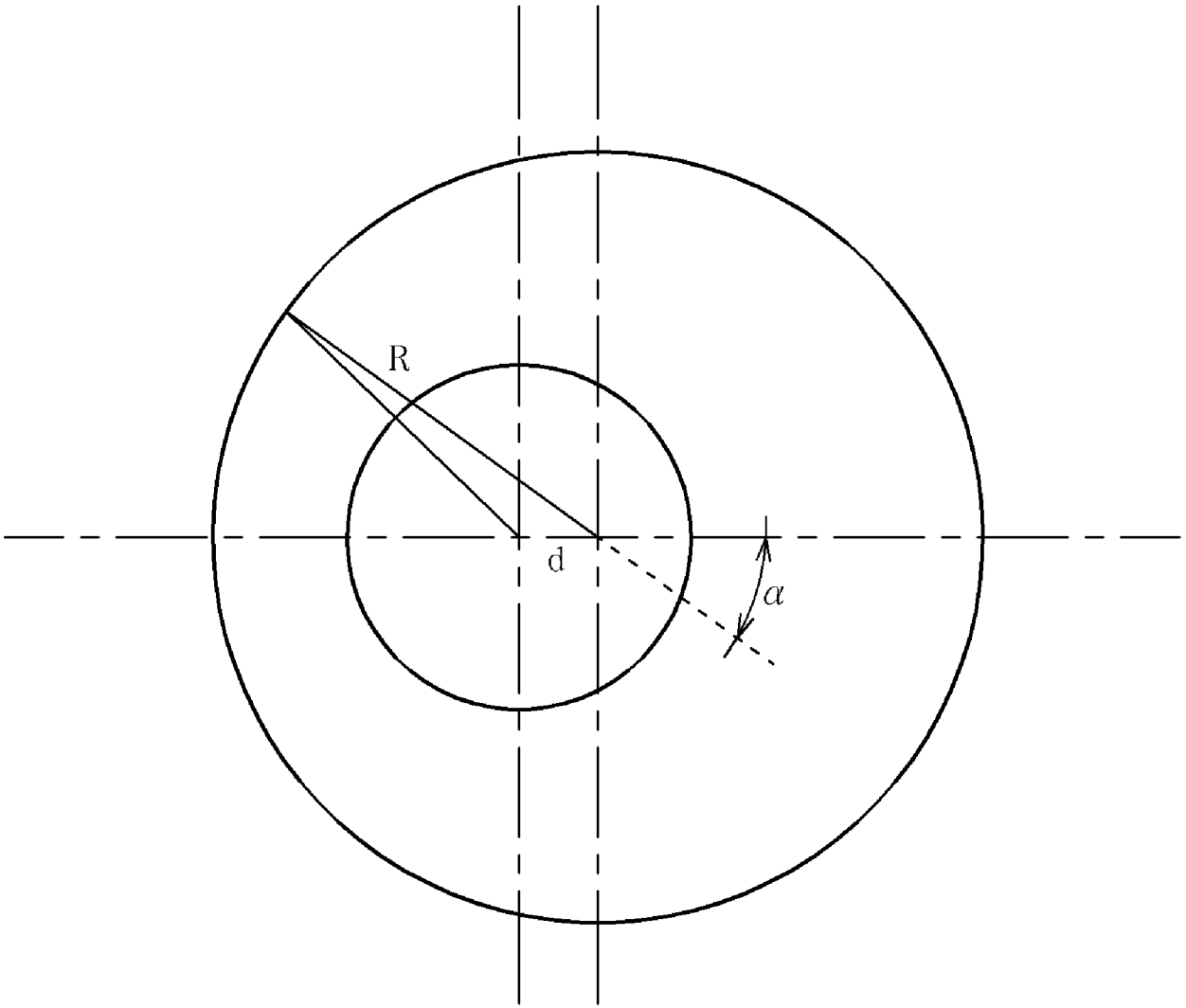
FIG. 2 PRIOR ART
FIG. 2 is an illustration of every primary parameter of the eccentric cylinder.
Figure 3:
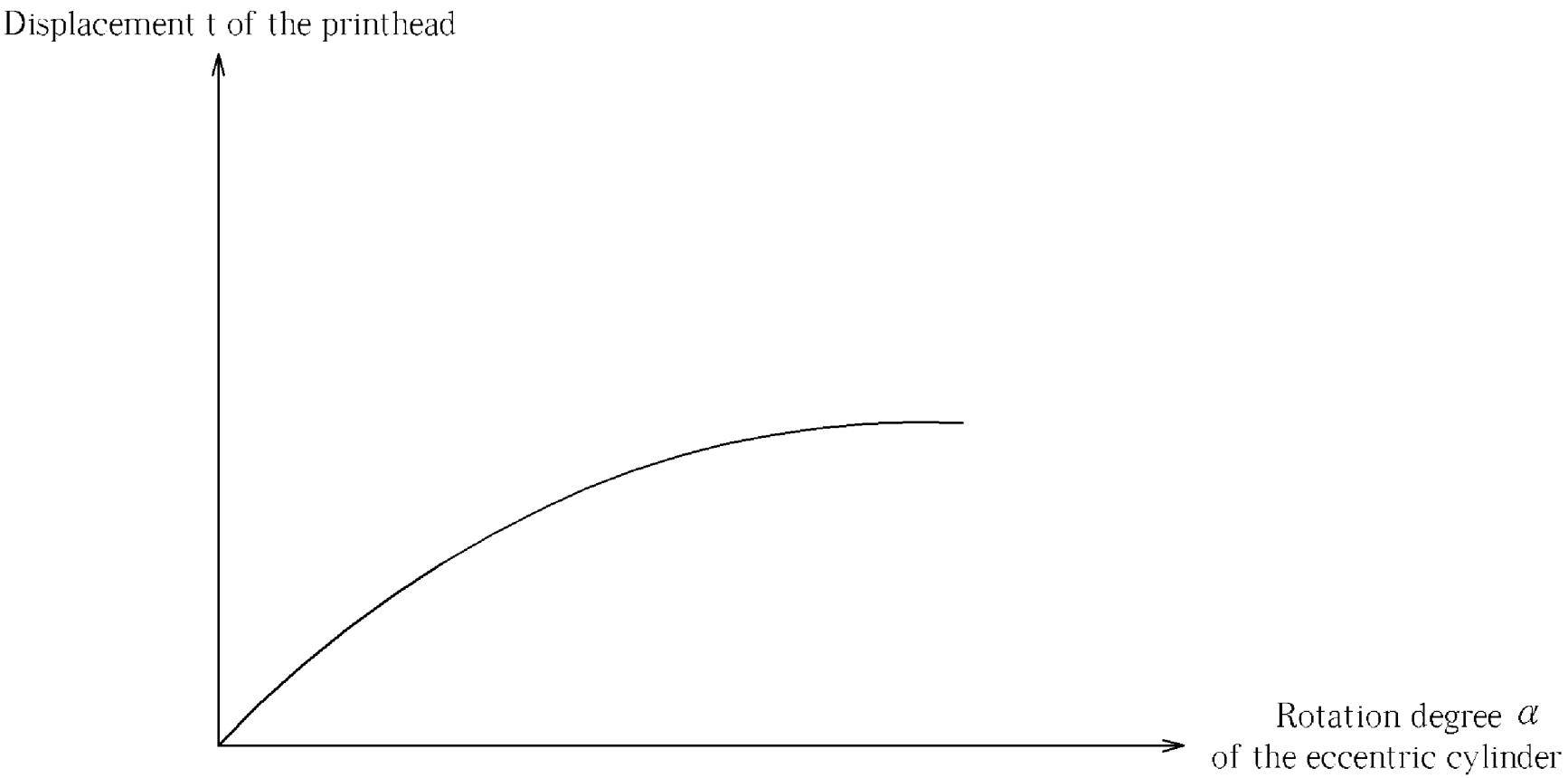
FIG. 3 PRIOR ART
FIG. 3 is an illustration of the relation between the rotation degree $\alpha$ of the eccentric cylinder and the displacement t of the printhead.
Figure 4:
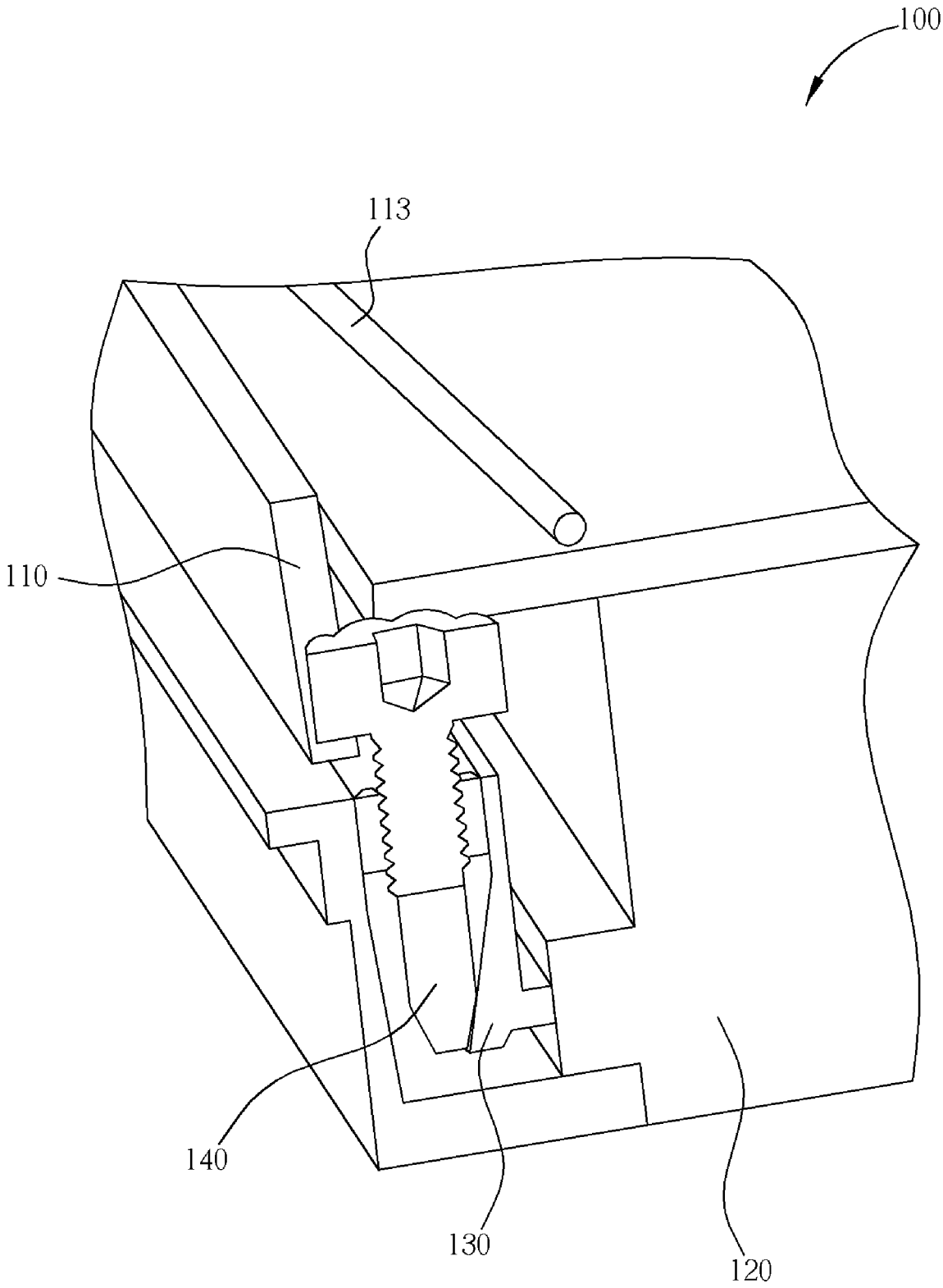
FIG. 4 is an illustration of a first exemplary embodiment of the tuning apparatus for a printhead according to the present invention.

Please refer to FIG. 4. FIG. 4 is an illustration of a first exemplary embodiment of the tuning apparatus 100 for a printhead according to the present invention. The tuning apparatus 100 comprises a carrier 110, a printhead device 120, a pushing element 130, and a tuning element 140. The carrier 110 is usually in the form of the cartridge in a printer or bodies that can carry the printhead. The printhead device 120 is controlled by a control unit of the printer for ejecting ink drops onto printing media. The printhead device 120 is configured on the carrier 110 and allowed for having displacement relative to the carrier 110 along a first direction, the direction H1 or H2 shown in FIG. 5. In the exemplary embodiment, the printhead device 120 can be calibrated with its position on the carrier 110 by having slightly horizontal displacement along the direction H1 or H2 relative to the carrier 110.

Figure 5:
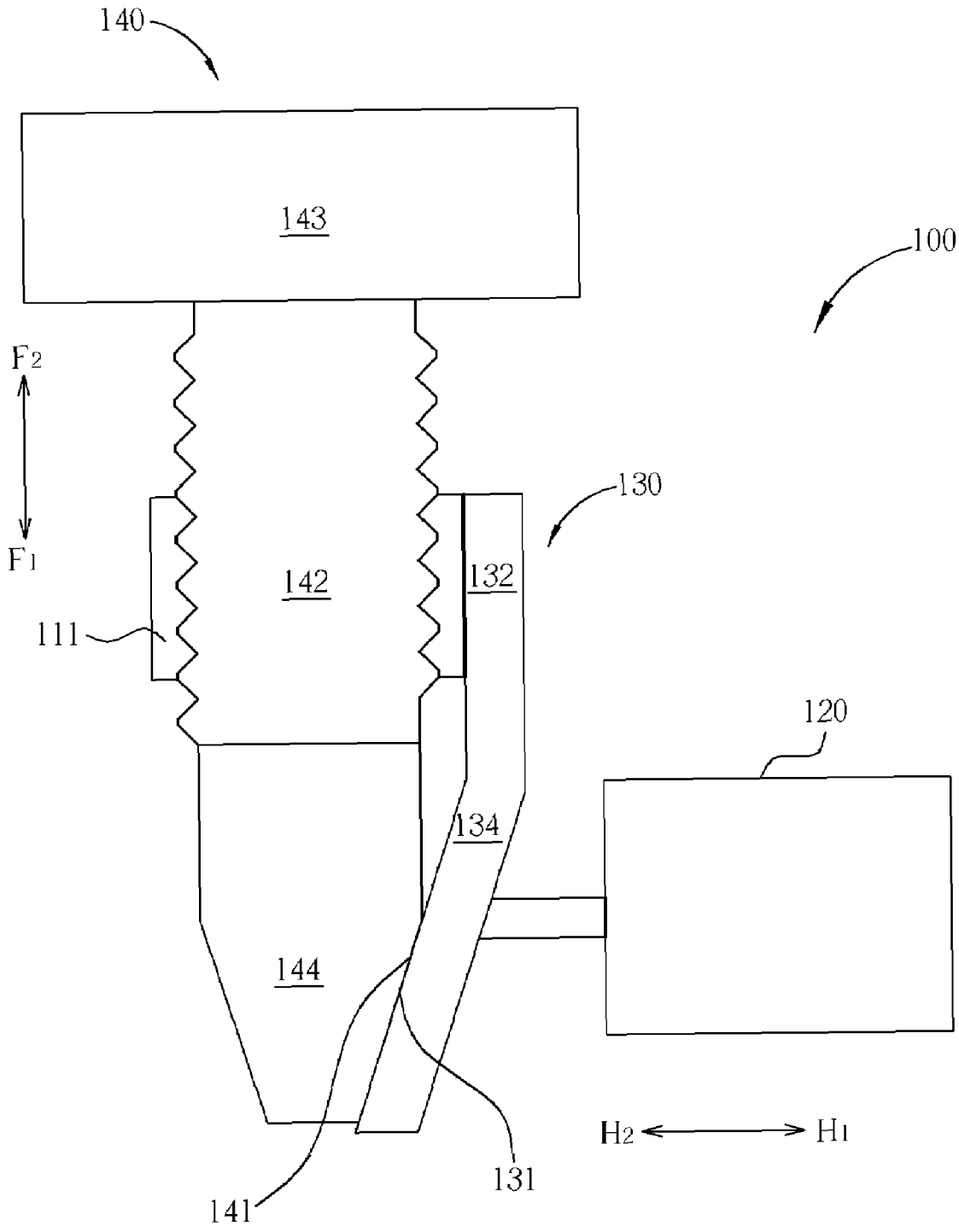
FIG. 5 is the cross-section view of the tuning apparatus according to the present invention.
Figure 9:
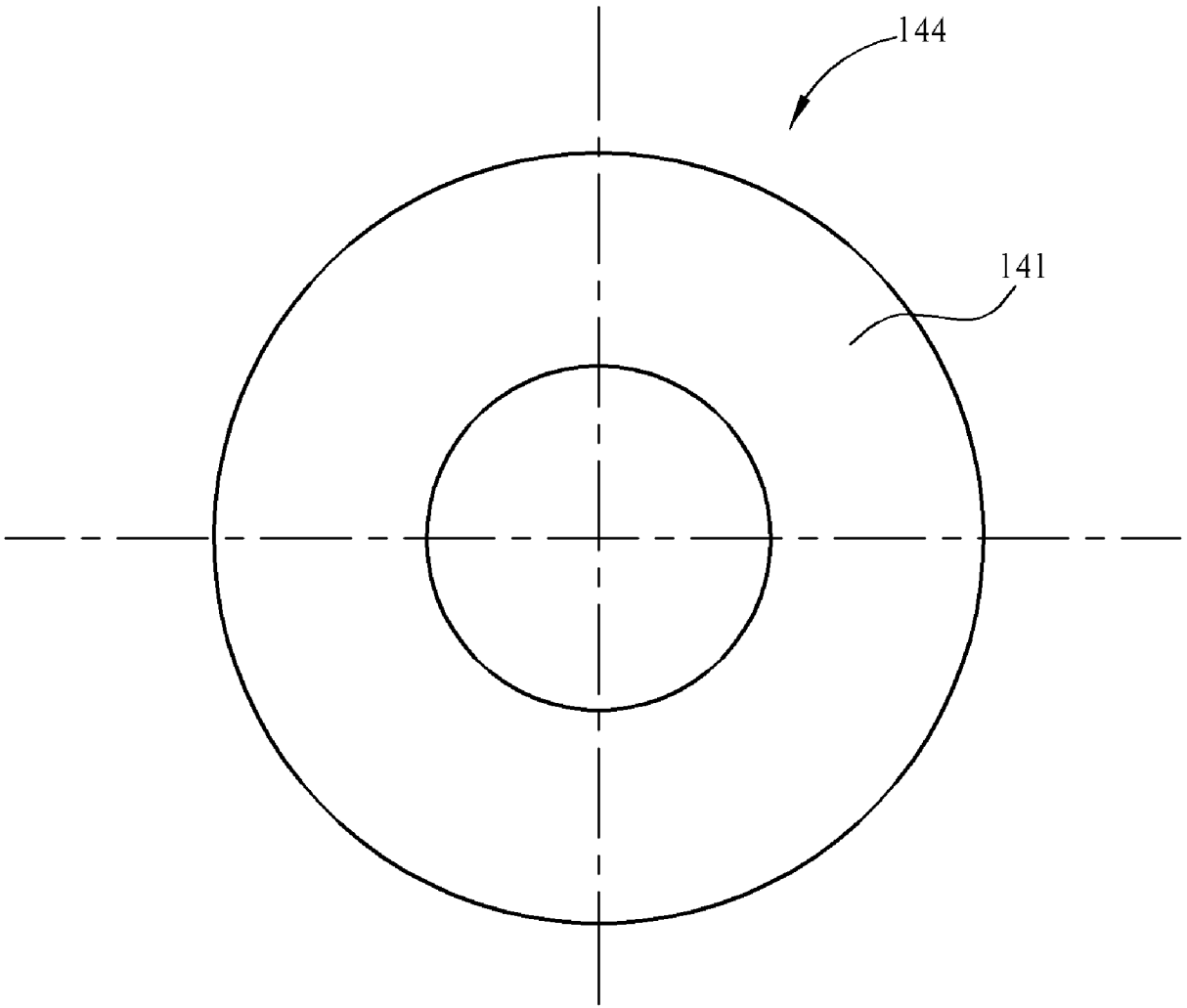
FIG. 9 is the cross-section view of a first exemplary embodiment of the tuning element according to the present invention.
Figure 10:
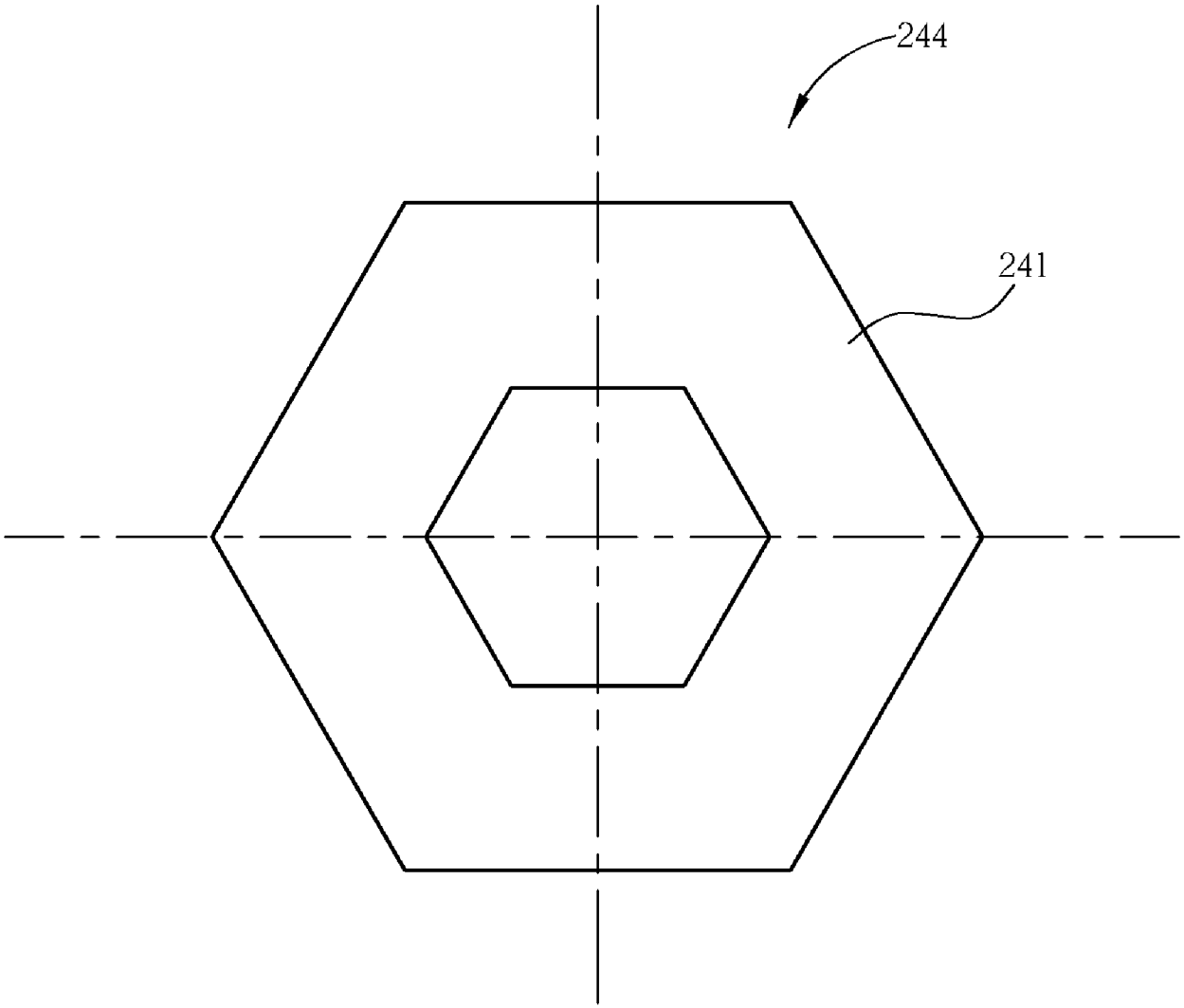
FIG. 10 is the cross-section view of a second exemplary embodiment of the tuning element according to the present invention.

Please refer to FIG. 5. FIG. 5 is the cross-section view of each element of the tuning apparatus 100 according to the present invention. The present invention carries out tuning the displacement of the printhead device 120 relative to the carrier 110 by moving the tuning element 140 in a second direction, the vertical direction in the embodiment. The tuning element 140 then pushes the printhead device 120 with an inclined plane to move in a first direction, the horizontal direction in the embodiment. The tuning element 140 in the embodiment of the present invention is a screw having continuous threads. The plurality of threads on a second section 142 of the tuning element 140 fits with an engagement section 111 of the carrier 110 such that when the tuning element 140 rotates relative to the carrier 110, the fitting between the tuning element 140 and the engagement section 111 allows the tuning element 140 to move vertically along direction F1 or F2. The first section 144 of the tuning element 140 is an inclined cone, with cross-section as shown in FIG. 9, or a polyhedron, with cross-section as shown in FIG. 10. The first section 144 has a second inclined plane 141. The pushing element 130 is an elastic arm extending from the carrier 110. The stationary section 132 of the pushing element 130 fixes and extends from the carrier 110 and the moving section 134 has a first inclined plane 131 for closely contacting the second inclined plane 141 on the first section 144 of the tuning element 140. When the tuning element 140 rotates and has displacement along direction F1, the second inclined plane 141 pushes the first inclined plane 131, and further pushes the moving section 134 of the pushing element 130 to slightly move along direction H1. Since the moving section 134 is also closely contacting one side of the printhead device 120, the printhead device 120 also has displacement along direction H1 relative to the carrier 110 when pushed by the moving section 134, which is pushed earlier by the tuning element 140 along direction H1. Finally, the printhead device 120 is tuned in the displacement in direction H1.

On the other way, when the tuning element 140 rotates relative to the carrier 110 and has displacement along direction F2, the second inclined plane 141 also moves along the direction F2, which brings up the result that the forces exerted on the first inclined plane 131 decreases. Since the moving section 134 is an elastic arm and due to the decrease of exertion force on the first inclined plane 131, the moving section 134 is prone to restore to its original shape heading to direction H2. Meanwhile, an elastic element 113, which is shown in FIG. 4, is connected between the carrier 110 and the printhead device 120 in the tuning apparatus 100. The elastic element 113 is designed for pressing the printhead device 120 both in directions F1 and H2. When the moving section 134 moves toward direction H2 for restoration, the printhead device 120 is slightly pushed by the elastic element 113 toward direction H2 and has displacement along direction H2 relative to the carrier 110. Additionally, the press in direction F1 from the elastic element 113 to the printhead device 120 also guarantees the printhead device 120 with merely horizontal displacement (or direction H1 in FIG. 5) when pushed by the pushing element 130.

Figure 6:
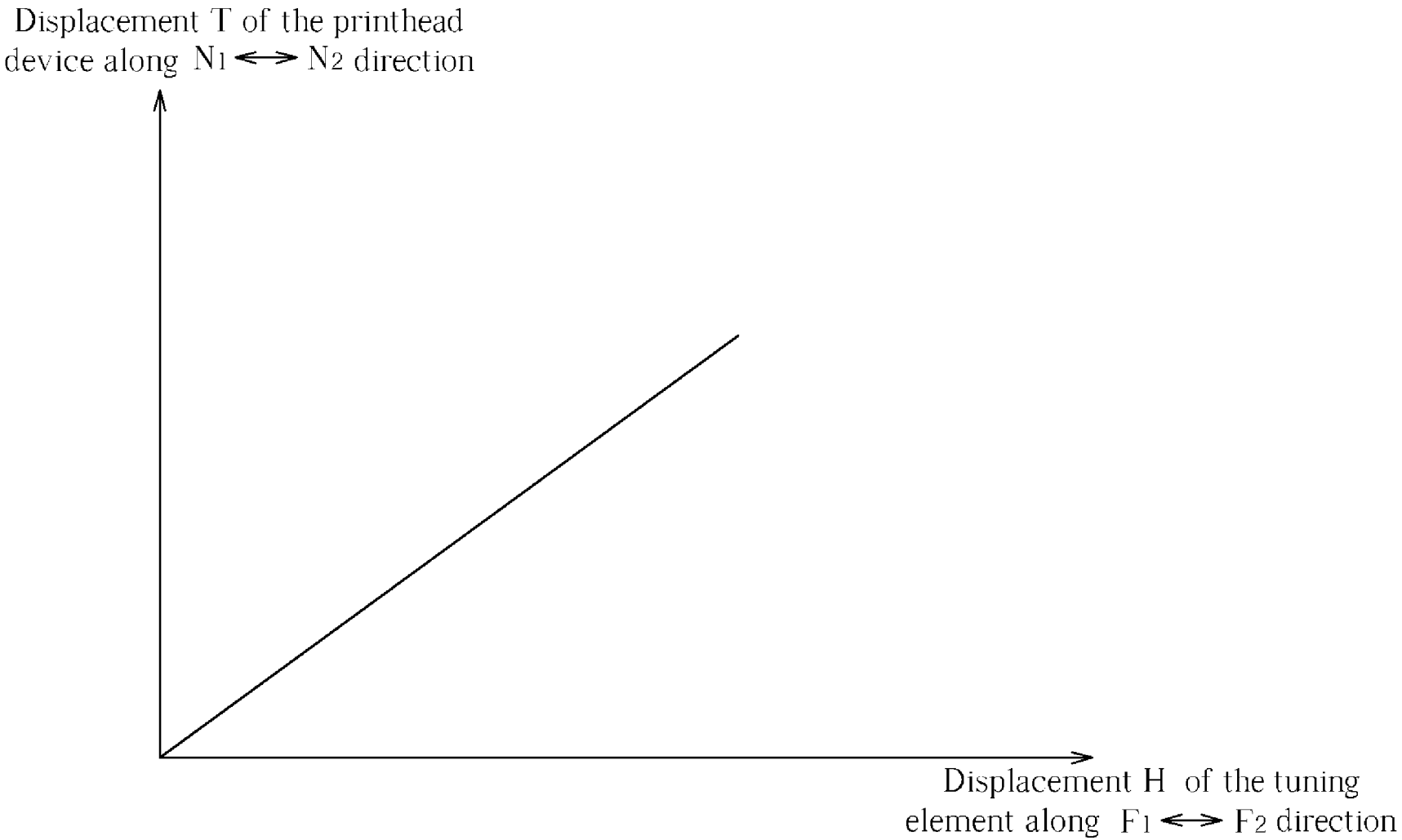
FIG. 6 is an illustration of the relation between the displacement H of the tuning element along a first direction and the displacement T of the printhead device along a second direction.
Figure 7:
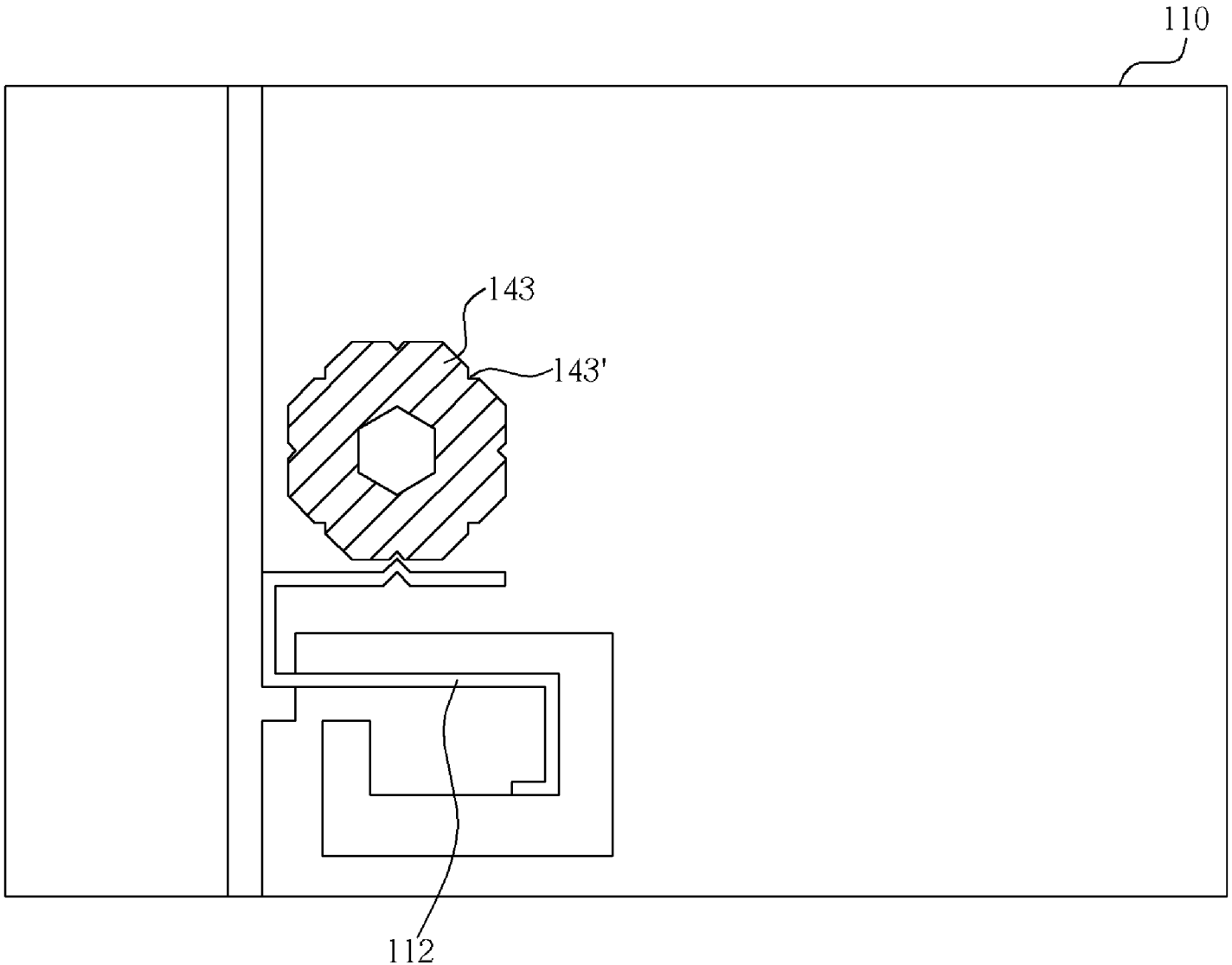
FIG. 7 is the top view of the tuning apparatus for the printhead.

In the prior operation process, the rotation degree of the tuning element 140 relative to the carrier 110 is linearly related to its displacement along direction F1 or F2. With further displacement transition between the first inclined plane 131 and the second inclined plane 141, the displacement in direction H1 or H2 occurred on the pushing element 130 and the printhead device 120 is also linearly related to the rotation degree of the tuning element 140. To express the linear relation alternatively, the tuning apparatus 100 disclosed in the present invention has linear relations between the rotation degree of the tuning element 140, the displacement H of the tuning element 140 along the first direction, and the displacement T of the printhead device 120 along the second direction, which is shown in FIG. 6. Additionally, the tuning element 140 further comprises a polygon screw nut 143 (please also refer to FIG. 7 for a top view of the tuning apparatus 100) that has equilateral octagon shape in the embodiment disclosed and there is a small indentation 143' on each side of the screw nut 143. A positioning component 112 configured on the carrier 110 is utilized for withstanding the indentation 143' on one side of the screw nut 143 so that the tuning element 140 can be tuned by steps and also free from rotating unintentionally. Please refer to FIG. 10. For a polyhedron shape in the cross section of the first section 244 of the tuning element, the second inclined plane 241 on the first section 244 can also perform stepping tuning and also prevent the tuning element from rotating unintentionally when contacting the first inclined plane 131.

An example is described here. If the design requirement for a printhead device's tuning displacement is a 0.01 mm~0.02 mm accuracy, with the thread pitch of the tuning element 140 being 0.6 mm and the included angle of the first inclined plane 131 and the second inclined plane 141 to the first direction being 12°, first the displacement T of the printhead device 120 along the second direction and the displacement H of the tuning element 140 along the first direction have the relation as the following:

$$T=H*\tan 12°;$$

For an equilateral octagon shape screw nut 143, every rotation of one side of the screw nut 143 causes the tuning element 140 to have displacement H along the first direction as 0.075 mm (0.6/8=0.075). H is then transformed by the included angle 12° of the first inclined plane 131 and produces 0.015 mm displacement T, which satisfies the design requirement for the tuning displacement accuracy, between 0.01 mm and 0.02 mm.

Figure 8:
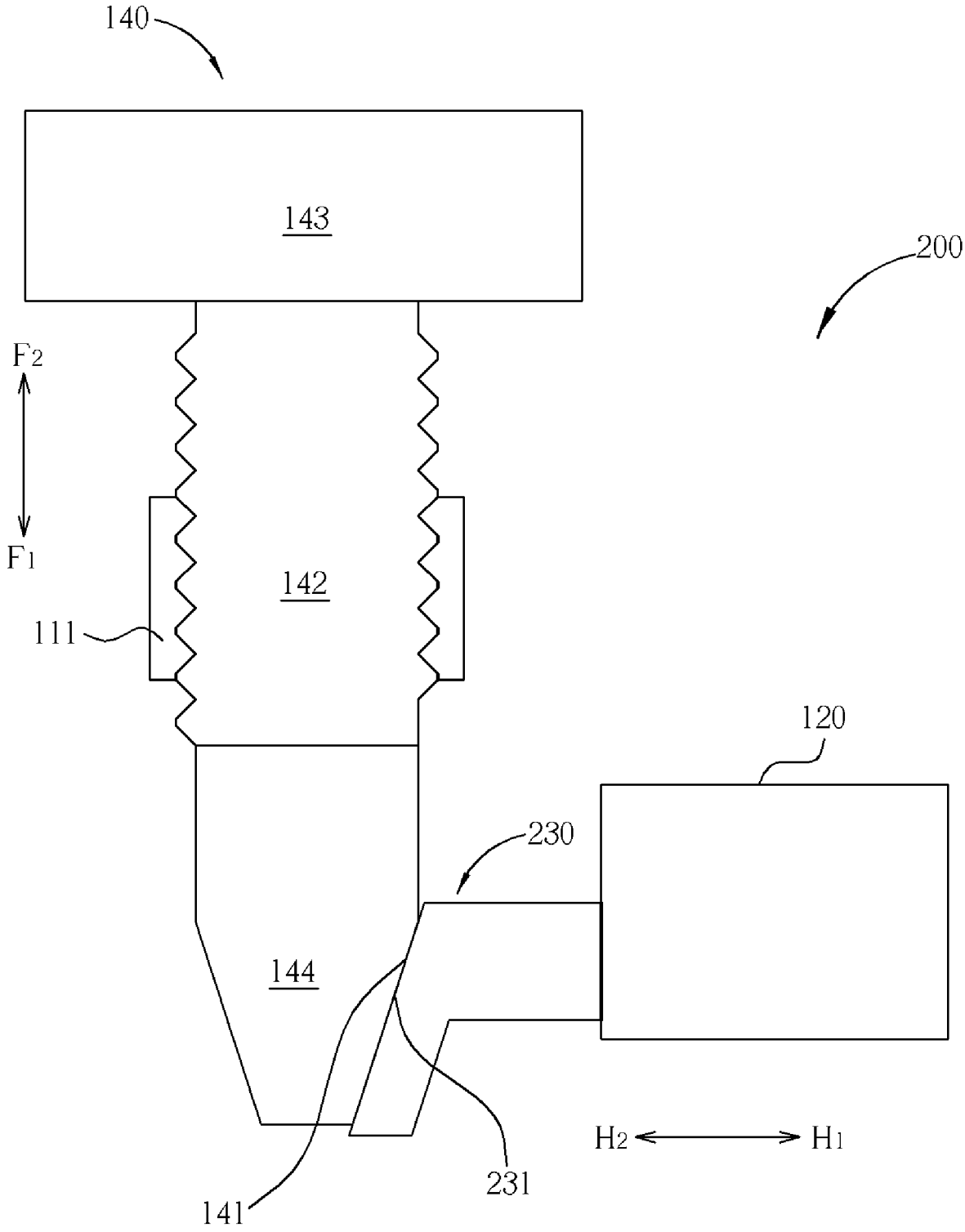
FIG. 8 is an illustration of a second exemplary embodiment of the tuning apparatus for a printhead according to the present invention.

Please refer to FIG. 8. Apart from using the pushing element 130 extending from the carrier 110 to push the printhead device 120 in the first exemplary embodiment, the second exemplary embodiment of the tuning apparatus 200 uses a sliding piece 230 to push the printhead device 120. The sliding piece 230 is fixed on the printhead device 120 and capable of moving with the printhead device 120 along direction H1 or H2. The sliding piece 230 also has a first inclined plane 231 for interacting with the second inclined plane 141 on the tuning element 140. Detailed description of how the sliding piece 230 works with the tuning element 140 is similar with the first exemplary embodiment and therefore omitted herein for brevity.

The present invention utilizes a tuning element having a second inclined plane to interact with a pushing element having a first inclined plane to accomplish adjusting the position of a printhead device. The tuning element rotates relative to a printhead carrier and produces displacement in a second direction and the second inclined plane of the tuning element then pushes the first inclined plane of the pushing element and produces displacement in a first direction in a linear way corresponding to the rotation of the tuning element. Meanwhile, the printhead device closely in contact with the pushing element also produces displacement in the first direction so that the tuning apparatus is endowed with highly accurate and linear adjustability.

Those skilled in the art will readily observe that numerous modifications and alterations of the device and method may be made while retaining the teachings of the invention.

What is claimed is:

1. A tuning apparatus for a printhead, comprising:

a carrier;

a printhead device configured on the carrier and capable of having displacement relative to the carrier along a first direction;

a pushing element utilized for pushing the printhead device to move relative to the carrier along the first direction, the pushing element having a first inclined plane; and a tuning element configured on the carrier and capable of having displacement relative to the carrier along a second direction, the tuning element having a second inclined plane for interacting with the first inclined plane of the pushing element, causing the pushing element to push the printhead device to move relative to the carrier along the first direction when the tuning element has displacement along the second direction.

2. The tuning apparatus of claim 1, wherein the tuning element comprises a first section and a second section, the second inclined plane locating on the first section, the second section having continuous threads, and the tuning element having displacement relative to the carrier along the second direction when rotating relative to the carrier.

3. The tuning apparatus of claim 2, wherein the first section of the tuning element is an inclined cone having the second inclined plane.

4. The tuning apparatus of claim 2, wherein the first section of the tuning element is an inclined polyhedron having the second inclined plane.

5. The tuning apparatus of claim 1, wherein the tuning element is a screw.

6. The tuning apparatus of claim 5, further comprising a positioning component configured on the carrier, the tuning element further comprising a polygon screw nut, the positioning component being utilized for withstanding the side of the screw nut.

7. The tuning apparatus of claim 1, wherein the pushing element is an elastic arm extending from the carrier.

8. The tuning apparatus of claim 1, wherein the pushing element is a sliding piece fixed on the printhead device.

9. The tuning apparatus of claim 1, further comprising an elastic element connected between the carrier and the printhead device for limiting the printhead device to have displacement along the first direction.

* * * * *